US010139059B2

(12) United States Patent
Danesh

(10) Patent No.: US 10,139,059 B2
(45) Date of Patent: Nov. 27, 2018

(54) ADJUSTABLE COMPACT RECESSED LIGHTING ASSEMBLY WITH HANGAR BARS

(71) Applicant: DMF, Inc., Carson, CA (US)

(72) Inventor: Michael D. Danesh, Beverly Hills, CA (US)

(73) Assignee: DMF, Inc., Carson, CA (US)

( * ) Notice: Subject to any disclaimer, the term of this patent is extended or adjusted under 35 U.S.C. 154(b) by 0 days.

(21) Appl. No.: 14/183,424

(22) Filed: Feb. 18, 2014

(65) Prior Publication Data

US 2015/0233556 A1 Aug. 20, 2015

(51) Int. Cl.

| | |
|---|---|
| ***F21S 8/02*** | (2006.01) |
| ***F21V 21/04*** | (2006.01) |
| *F21V 23/00* | (2015.01) |
| *F21Y 115/10* | (2016.01) |

(52) U.S. Cl.

CPC ..... *F21S 8/02* (2013.01); *F21S 8/026* (2013.01); *F21V 21/048* (2013.01); *F21V 23/009* (2013.01); *F21Y 2115/10* (2016.08)

(58) Field of Classification Search

CPC . F21V 21/04–21/049; F21S 8/02; F21S 8/026
See application file for complete search history.

(56) References Cited

U.S. PATENT DOCUMENTS 2,038,784 A 4/1936 Ghadiali
3,422,261 A * 1/1969 McGinty ..... F21S 8/02 362/296.01
3,460,299 A 8/1969 Wilson
3,650,046 A 3/1972 Skinner
(Continued)

FOREIGN PATENT DOCUMENTS

CA 2815067 11/2013
CN 201259125 Y 6/2009
(Continued)

OTHER PUBLICATIONS

DMF, Inc., "dmfLighting: LED Recessed Lighting Solutions", Info sheets, (Mar. 19, 2012), (4 pages).
(Continued)

*Primary Examiner* — Anh Mai
*Assistant Examiner* — Steven Horikoshi
(74) *Attorney, Agent, or Firm* — Cooley LLP

(57) ABSTRACT

A compact recessed lighting system is provided. The recessed lighting system includes a light source module and a driver coupled to a unified casting and within a shared junction box. The junction box may be coupled to a set of hangar holders that are movably coupled to a corresponding set of hangar bars. The junction box, including the light source module and driver installed therein, may move both 1) along the hangar bars and 2) along an axis perpendicular to the hangar bars. Accordingly, the junction box may be moved to rest in preferred location between a set of joists or beams in a structure. By being configured such that the junction box, along with the light source module and driver, is coupled to a unified set of moveable elements that position the combined structure, the recessed lighting system eliminates the added bulk and size of traditional recessed lighting systems.

22 Claims, 7 Drawing Sheets

(56) References Cited

U.S. PATENT DOCUMENTS 4,088,827 A 5/1978 Kohaut
4,399,497 A 8/1983 Druffel
4,520,435 A 5/1985 Baldwin
4,601,145 A 7/1986 Wilcox
4,723,747 A * 2/1988 Karp et al. ..... 248/298.1
4,729,080 A 3/1988 Fremont et al.
4,754,377 A * 6/1988 Wenman ..... F21S 8/02 362/148
4,930,054 A 5/1990 Krebs
5,216,203 A 6/1993 Gower
5,250,269 A 10/1993 Langer et al.
5,382,752 A 1/1995 Reyhan et al.
5,465,199 A 11/1995 Bray et al.
5,544,870 A 8/1996 Kelley et al.
5,562,343 A 10/1996 Chan et al.
5,571,993 A 11/1996 Jones et al.
5,580,158 A * 12/1996 Aubrey ..... F21S 8/02 362/260
5,588,737 A * 12/1996 Kusmer ..... 362/148
5,603,424 A 2/1997 Bordwell et al.
D381,111 S 7/1997 Lecluze
5,662,413 A 9/1997 Akiyama
D386,277 S 11/1997 Lecluze
D387,466 S 12/1997 Lecluze
5,738,436 A 4/1998 Cummings et al.
5,836,678 A 11/1998 Wright et al.
5,942,726 A 8/1999 Reiker
5,944,412 A 9/1999 Janos et al.
6,082,878 A 7/2000 Doubek et al.
6,105,334 A * 8/2000 Monson ..... F21S 8/02 52/232
6,161,910 A 12/2000 Reisenauer et al.
6,170,685 B1 1/2001 Currier
6,174,076 B1 1/2001 Petrakis et al.
6,267,491 B1 7/2001 Parrigin
6,350,043 B1 2/2002 Gloisten
6,364,511 B1 4/2002 Cohen
D461,455 S 8/2002 Forbes
6,474,846 B1 11/2002 Kelmelis et al.
6,491,413 B1 12/2002 Benesohn
6,583,573 B2 6/2003 Bierman
6,585,389 B2 7/2003 Bonazzi
D488,583 S 4/2004 Benghozi
6,719,438 B2 4/2004 Sevack et al.
6,758,578 B1 7/2004 Chou
D509,314 S 9/2005 Rashidi
6,948,829 B2 9/2005 Verdes et al.
6,964,501 B2 11/2005 Ryan
D516,235 S 2/2006 Rashidi
D528,673 S 9/2006 Maxik et al.
D531,740 S 11/2006 Maxik
D532,532 S 11/2006 Maxik
7,186,008 B2 3/2007 Patti
7,190,126 B1 3/2007 Paton
D547,889 S 7/2007 Huang
D553,267 S 10/2007 Yuen
7,320,536 B2 1/2008 Petrakis et al.
D561,372 S 2/2008 Yan
D570,012 S 5/2008 Huang
7,374,308 B2 5/2008 Sevack et al.
D570,504 S 6/2008 Maxik et al.
D570,505 S 6/2008 Maxik et al.
7,399,104 B2 7/2008 Rappaport
D578,677 S 10/2008 Huang
7,431,482 B1 10/2008 Morgan et al.
7,473,005 B2 1/2009 O'Brien
7,488,097 B2 2/2009 Reisenauer et al.
7,503,145 B2 3/2009 Newbold et al.
7,524,089 B2 4/2009 Park
D591,894 S 5/2009 Flank
7,534,989 B2 5/2009 Suehara et al.
7,566,154 B2 7/2009 Gloisten et al.
D599,040 S 8/2009 Alexander et al.
D600,836 S 9/2009 Hanley et al.
7,588,359 B2 9/2009 Coushaine et al.
7,592,583 B2 9/2009 Page et al.
D606,696 S 12/2009 Chen et al.
7,625,105 B1 * 12/2009 Johnson ..... 362/364
7,628,513 B2 12/2009 Chin
7,651,238 B2 1/2010 O'Brien
7,654,705 B2 2/2010 Czech et al.
D611,650 S 3/2010 Broekhoff
7,670,021 B2 3/2010 Chou
7,677,766 B2 3/2010 Boyer
D616,118 S 5/2010 Thomas et al.
7,722,208 B1 5/2010 Dupre et al.
7,722,227 B2 5/2010 Zhang et al.
7,748,887 B2 7/2010 Zampini, II et al.
7,771,082 B2 8/2010 Peng
D624,692 S 9/2010 Mackin et al.
D625,847 S 10/2010 Maglica
D625,876 S 10/2010 Chen et al.
D627,727 S 11/2010 Alexander et al.
7,828,465 B2 11/2010 Roberge et al.
7,871,184 B2 1/2011 Peng
D633,224 S 2/2011 Lee
D636,903 S 4/2011 Torenbeek
D637,339 S 5/2011 Hasan et al.
D637,340 S 5/2011 Hasan et al.
7,950,832 B2 5/2011 Tanaka et al.
D639,499 S 6/2011 Choi et al.
D640,819 S 6/2011 Pan
7,959,332 B2 6/2011 Tickner et al.
7,967,480 B2 6/2011 Pickard et al.
D642,317 S 7/2011 Rashidi
7,972,035 B2 7/2011 Boyer
7,972,043 B2 7/2011 Schutte
D643,970 S 8/2011 Kim et al.
D646,011 S 9/2011 Rashidi
8,038,113 B2 10/2011 Fryzek et al.
D648,476 S 11/2011 Choi et al.
D648,477 S 11/2011 Kim et al.
D650,115 S 12/2011 Kim et al.
8,070,328 B1 * 12/2011 Knoble et al. ..... 362/311.02
8,096,670 B2 1/2012 Trott et al.
D654,205 S 2/2012 Rashidi
D656,263 S 3/2012 Ogawa et al.
8,142,057 B2 3/2012 Roos et al.
8,152,334 B2 4/2012 Krogman
D658,788 S 5/2012 Dudik et al.
D658,802 S 5/2012 Chen
D659,862 S 5/2012 Tsai
D659,879 S 5/2012 Rashidi
D660,814 S 5/2012 Wilson
8,182,116 B2 5/2012 Zhang et al.
8,201,968 B2 6/2012 Maxik et al.
D663,058 S 7/2012 Pan
D663,466 S 7/2012 Rashidi
D664,274 S 7/2012 de Visser et al.
D664,705 S 7/2012 Kong et al.
8,215,805 B2 7/2012 Cogliano et al.
8,220,970 B1 7/2012 Khazi
8,226,270 B2 7/2012 Yamamoto et al.
D667,155 S 9/2012 Rashidi
8,262,255 B1 9/2012 Rashidi
D668,372 S 10/2012 Renshaw et al.
D668,809 S 10/2012 Rashidi
D669,198 S 10/2012 Qui
D669,199 S 10/2012 Chuang
D669,620 S 10/2012 Rashidi
8,277,090 B2 10/2012 Fryzek et al.
8,308,322 B2 11/2012 Santiago et al.
D673,869 S 1/2013 Yu
8,376,593 B2 2/2013 Bazydola et al.
D677,417 S 3/2013 Rashidi
D679,047 S 3/2013 Tickner et al.
8,403,533 B1 3/2013 Paulsel
8,403,541 B1 3/2013 Rashidi
D681,259 S 4/2013 Kong
8,408,759 B1 4/2013 Rashidi
D682,459 S 5/2013 Gordin et al.
D683,063 S 5/2013 Lopez et al.
D683,890 S 6/2013 Lopez et al.
D684,269 S 6/2013 Wang et al.

(56) References Cited

U.S. PATENT DOCUMENTS

D684,719 S 6/2013 Rashidi
D685,118 S 6/2013 Rashidi
D685,120 S 6/2013 Rashidi
8,454,204 B1 6/2013 Chang et al.
D685,507 S 7/2013 Sun
D687,586 S 8/2013 Rashidi
D687,587 S 8/2013 Rashidi
D687,588 S 8/2013 Rashidi
D687,980 S 8/2013 Gravely et al.
D688,405 S 8/2013 Kim et al.
D690,049 S 9/2013 Rashidi
D690,864 S 10/2013 Rashidi
D690,865 S 10/2013 Rashidi
D690,866 S 10/2013 Rashidi
D691,314 S 10/2013 Rashidi
D691,315 S 10/2013 Samson
8,550,669 B2 10/2013 Macwan et al.
D693,043 S 11/2013 Schmalfuss et al.
D693,517 S 11/2013 Davis
D694,456 S 11/2013 Rowlette, Jr. et al.
D695,441 S 12/2013 Lui et al.
D696,446 S 12/2013 Huh
D696,447 S 12/2013 Huh
D696,448 S 12/2013 Huh
8,602,601 B2 12/2013 Khazi et al.
D698,067 S 1/2014 Rashidi
D698,068 S 1/2014 Rashidi
D698,985 S 2/2014 Lopez et al.
D699,384 S 2/2014 Rashidi
D700,387 S 2/2014 Snell
8,641,243 B1 2/2014 Rashidi
D701,466 S 3/2014 Clifford et al.
8,672,518 B2 3/2014 Boomgaarden et al.
D702,867 S 4/2014 Kim et al.
D703,843 S 4/2014 Cheng
8,684,569 B2 4/2014 Pickard et al.
D705,472 S 5/2014 Huh
8,727,582 B2 5/2014 Brown et al.
D708,381 S 7/2014 Rashidi
D710,529 S 8/2014 Lopez et al.
8,801,217 B2 8/2014 Oehle et al.
D714,989 S 10/2014 Rowlette, Jr. et al.
8,870,426 B2 10/2014 Biebl et al.
8,890,414 B2 11/2014 Rowlette, Jr. et al.
D721,845 S 1/2015 Lui et al.
D722,296 S 2/2015 Taylor
D722,978 S 2/2015 Hagarty
8,950,898 B2 2/2015 Catalano
D726,363 S 4/2015 Danesh
D726,949 S 4/2015 Redfern
9,039,254 B2 5/2015 Danesh
D731,689 S 6/2015 Bernard et al.
9,062,866 B1* 6/2015 Christ ..... F21V 29/004
9,068,719 B2 6/2015 Van De Ven et al.
D734,525 S 7/2015 Gordin et al.
D735,142 S 7/2015 Hagarty
9,078,299 B2 7/2015 Ashdown
D739,590 S 9/2015 Redfern
9,140,441 B2 9/2015 Goelz et al.
9,151,457 B2 10/2015 Pickard et al.
9,151,477 B2 10/2015 Pickard et al.
9,285,103 B2 3/2016 Van De Ven et al.
9,291,319 B2 3/2016 Kathawate et al.
9,301,362 B2 3/2016 Dohn et al.
9,310,038 B2 4/2016 Athalye
9,347,655 B2 5/2016 Boomgaarden et al.
D762,181 S 7/2016 Lin
D762,906 S 8/2016 Jeswani et al.
D764,079 S 8/2016 Wu
9,417,506 B1 8/2016 Tirosh
D766,185 S 9/2016 Hagarty
D768,325 S 10/2016 Xu
D768,326 S 10/2016 Guzzini
D769,501 S 10/2016 Jeswani et al.
D770,065 S 10/2016 Tittle
9,476,552 B2 10/2016 Myers et al.
D776,324 S 1/2017 Gierl et al.
D777,967 S 1/2017 Redfern
9,534,751 B2 1/2017 Maglica et al.
D778,241 S 2/2017 Holbrook et al.
D778,484 S 2/2017 Guzzini
D779,100 S 2/2017 Redfern
9,581,302 B2 2/2017 Danesh
9,599,315 B1 3/2017 Harpenau et al.
9,605,910 B2 3/2017 Swedberg et al.
D785,228 S 4/2017 Guzzini
D786,472 S 5/2017 Redfern
D786,474 S 5/2017 Fujisawa
D790,102 S 6/2017 Guzzini
9,673,597 B2 6/2017 Lee
9,702,516 B1 7/2017 Vasquez et al.
9,791,111 B1 10/2017 Huang et al.
9,803,839 B2 10/2017 Visser et al.
D809,176 S 1/2018 Partington
2002/0172047 A1 11/2002 Ashley
2005/0225966 A1 10/2005 Hartmann et al.
2005/0227536 A1 10/2005 Gamache et al.
2005/0237746 A1 10/2005 Yiu
2006/0158873 A1 7/2006 Newbold et al.
2006/0215408 A1 9/2006 Lee
2007/0035951 A1 2/2007 Tseng
2007/0185675 A1 8/2007 Papamichael et al.
2007/0206374 A1 9/2007 Petrakis et al.
2008/0112168 A1 5/2008 Pickard et al.
2008/0112170 A1 5/2008 Trott
2008/0112171 A1 5/2008 Patti et al.
2008/0137347 A1 6/2008 Trott et al.
2008/0165545 A1 7/2008 O'Brien
2008/0232116 A1 9/2008 Kim
2009/0003009 A1 1/2009 Tessnow et al.
2009/0034261 A1 2/2009 Grove
2009/0080189 A1* 3/2009 Wegner ..... 362/235
2009/0135613 A1 5/2009 Peng
2009/0141500 A1 6/2009 Peng
2009/0141508 A1 6/2009 Peng
2009/0147517 A1 6/2009 Li
2009/0161356 A1 6/2009 Negley et al.
2009/0237924 A1 9/2009 Ladewig
2009/0280695 A1 11/2009 Sekela et al.
2010/0014282 A1 1/2010 Danesh
2010/0061108 A1 3/2010 Zhang et al.
2010/0110690 A1 5/2010 Hsu et al.
2010/0110698 A1 5/2010 Harwood et al.
2010/0148673 A1 6/2010 Stewart et al.
2010/0149822 A1 6/2010 Cogliano et al.
2010/0244709 A1 9/2010 Steiner et al.
2010/0246172 A1 9/2010 Liu
2010/0259919 A1 10/2010 Khazi et al.
2010/0270903 A1 10/2010 Jao et al.
2010/0302778 A1 12/2010 Dabiet et al.
2011/0063831 A1 3/2011 Cook
2011/0068687 A1 3/2011 Takahasi et al.
2011/0069499 A1 3/2011 Trott et al.
2011/0116276 A1 5/2011 Okamura et al.
2011/0134634 A1 6/2011 Gingrich, III et al.
2011/0134651 A1 6/2011 Berman
2011/0170294 A1 7/2011 Mier-Langner et al.
2011/0194299 A1* 8/2011 Crooks et al. ..... 362/427
2011/0216534 A1 9/2011 Tickner et al.
2011/0226919 A1* 9/2011 Fryzek et al. ..... 248/298.1
2011/0255292 A1 10/2011 Shen
2011/0267828 A1 11/2011 Bazydola et al.
2012/0020104 A1 1/2012 Biebl et al.
2012/0074852 A1 3/2012 Delnoij
2012/0106176 A1 5/2012 Lopez et al.
2012/0113642 A1 5/2012 Catalano
2012/0140442 A1 6/2012 Woo et al.
2012/0162994 A1 6/2012 Wasniewski et al.
2012/0182744 A1* 7/2012 Santiago et al. ..... 362/365
2012/0188762 A1 7/2012 Joung et al.
2012/0287625 A1 11/2012 Macwan et al.
2013/0009552 A1 1/2013 Page
2013/0010476 A1 1/2013 Pickard et al.
2013/0051012 A1 2/2013 Oehle et al.

(56) References Cited

U.S. PATENT DOCUMENTS

| | | | | |
|---|---|---|---|---|
| 2013/0141913 | A1 | 6/2013 | Sachsenweger | |
| 2013/0163254 | A1 | 6/2013 | Chang et al. | |
| 2013/0170233 | A1 | 7/2013 | Nezu et al. | |
| 2013/0258677 | A1 | 10/2013 | Fryzek et al. | |
| 2013/0294084 | A1* | 11/2013 | Kathawate | F21S 8/026 362/294 |
| 2013/0322062 | A1 | 12/2013 | Danesh | |
| 2014/0049957 | A1* | 2/2014 | Goelz | F21V 29/763 362/235 |
| 2014/0140490 | A1 | 5/2014 | Roberts et al. | |
| 2014/0063818 | A1 | 6/2014 | Randolph et al. | |
| 2014/0254177 | A1 | 9/2014 | Danesh | |
| 2014/0347848 | A1 | 11/2014 | Pisavadia et al. | |
| 2015/0009676 | A1 | 1/2015 | Danesh | |
| 2015/0138779 | A1 | 5/2015 | Livesay et al. | |
| 2015/0184837 | A1 | 7/2015 | Zhang et al. | |
| 2015/0198324 | A1 | 7/2015 | O'Brien et al. | |
| 2015/0263497 | A1 | 9/2015 | Korcz et al. | |
| 2015/0276185 | A1 | 10/2015 | Bailey et al. | |
| 2015/0362159 | A1 | 12/2015 | Ludyjan | |
| 2016/0312987 | A1 | 10/2016 | Danesh | |
| 2016/0348860 | A1 | 12/2016 | Danesh | |
| 2016/0348861 | A1 | 12/2016 | Bailey et al. | |
| 2016/0366738 | A1 | 12/2016 | Boulanger et al. | |
| 2017/0045213 | A1 | 2/2017 | Williams et al. | |
| 2017/0138576 | A1 | 5/2017 | Peng et al. | |
| 2017/0307188 | A1 | 10/2017 | Oudina et al. | |

FOREIGN PATENT DOCUMENTS

| | | | |
|---|---|---|---|
| CN | 101608781 | A | 12/2009 |
| CN | 201636626 | U | 11/2010 |
| CN | 202392473 | U | 11/2011 |
| CN | 103307518 | A | 3/2012 |
| CN | 103322476 | A | 9/2013 |
| CN | 203215483 | U | 9/2013 |
| CN | 101498411 | B | 11/2013 |
| CN | 104654142 | A | 11/2013 |
| CN | 203273663 | U | 11/2013 |
| CN | 203297980 | U | 11/2013 |
| CN | 103712135 | B | 12/2013 |
| CN | 203628464 | U | 12/2013 |
| CN | 203641919 | U | 6/2014 |
| CN | 204513161 | U | 7/2015 |
| CN | 204611541 | U | 9/2015 |
| CN | 204829578 | U | 12/2015 |
| CN | 205606362 | U | 9/2016 |
| CN | 206130742 | U | 4/2017 |
| CN | 103154606 | B | 5/2017 |
| DE | 9109828 | U1 | 2/1992 |
| EP | 1 672 155 | A1 | 6/2006 |
| EP | 1672155 | A1 | 6/2006 |
| EP | 2 306 072 | A1 | 4/2011 |
| EP | 2 453 169 | A2 | 5/2012 |
| EP | 2 193 309 | B1 | 7/2012 |
| GB | 2509772 | A | 7/2014 |
| JP | 2011060450 | A2 | 3/2011 |
| JP | 2012064551 | A2 | 3/2012 |
| JP | 2015002027 | A2 | 6/2013 |
| JP | 2015002028 | A2 | 1/2015 |
| JP | 2016152166 | A2 | 8/2016 |
| JP | 2017107699 | A2 | 6/2017 |
| KR | 1020110008796 | A | 1/2011 |
| KR | 1020120061625 | A | 6/2012 |
| WO | WO 2013/128896 | A1 | 9/2013 |
| WO | WO 2015/000212 | A1 | 1/2015 |

OTHER PUBLICATIONS

Halo, Halo LED H4 H7 Collection, SustainabLEDesign, Cooper Lighting, (emphasis on p. 18 "H7 Collection LED Modules—Halo LED H7 Module Features"), (Mar. 28, 2012), (52 pages).

Halo, H7 LED Downlight Trims 49x Series, 6-inch LED Trims for Use With ML7x LED Modules, Cooper Lighting, ADV110422, (rev. Aug. 12, 2011), (15 pages).

CA Office Action (dated Dec. 23, 2013), Application No. 2,778,581, Date Filed—Jun. 1, 2012, 3 pages.

Non-Final Office Action (dated Oct. 16, 2014), U.S. Appl. No. 13/484,901, filed May 31, 2012, First Named Inventor: Michael D. Danesh, 15 pages.

Final Office Action (dated Apr. 2, 2015), U.S. Appl. No. 13/484,901, filed May 31, 2012, First Named Inventor: Michael D. Danesh, 13 pages.

Non-Final Office Action (dated Jul. 20, 2015), U.S. Appl. No. 14/184,601, filed Feb. 19, 2014, First Named Inventor: Michael D. Danesh, 19 pages.

Non-Final Office Action (dated Sep. 15, 2015), U.S. Appl. No. 13/484,901, filed May 31, 2012. First Named Inventor: Michael D. Danesh, 16.

Halo, LED Module ML706x, Cooper Lighting, General Installation for All Modules/p. 1; Tether Installation/pp. 2-3; Installation into Halo H750x Series LED-only (Non-Screw based) Recessed Fixture/p. 4, (Oct. 20, 2009), 4 pages.

Non-Final Office Action dated Feb. 6, 2018 from U.S. Appl. No. 15/167,682, 9 pages.

Non-Final Office Action dated Sep. 6, 2017 from U.S. Appl. No. 14/726,064, 8 pages.

Notice of Allowance dated Mar. 24, 2016 from U.S. Appl. No. 14/247,149, 8 pages.

"DME Series Installation Instructions", (Oct. 18, 2011).

Non-Final Office Action, dated Dec. 15, 2016, U.S. Appl. No. 14/184,601.

Canadian Office Action, dated Dec. 6, 2016, Canadian Application No. 2,879,629.

Final Office Action, dated Jul. 26, 2017, U.S. Appl. No. 14/184,601.

CA Office Action (Dated Feb. 1, 2016), Application No. 2,879,486, Filing Date: Jan. 23, 2015, First Named Inventor: Michael D. Danesh, 5.

CA Office Action (dated Mar. 22, 2016), Application No. 2,879,629, Filing Date: Jan. 23, 2015; First named Inventor: Michael D. Danesh.

Final Office Action (Dated Apr. 27, 2016), U.S. Appl. No. 14/184,601, filed Feb. 19, 2014, First Named Inventor: Michael D. Danesh, 18.

Final Office Action (dated Jun. 23, 2016), U.S. Appl. No. 13/484,901, filed May 31, 2012, First Named Inventor: Michael D. Danesh, 18 pages.

"Membrane Penetrations in Fire-Resistance Rated Walls," https://www.ul.com/wp-content/uploads/2014/04/ul_MembranePenetrations.pdf, Issue 1, 2009, 2 pages.

"Metallic and Non-metallic Outlet Boxes Used in Fire-rated Assembly," https://iaeimagazine.org/magazine/2000/09/16/metallic-and-non-metallic-outlet-boxes-used-in-fire-rated-assembly/, Sep. 16, 2000, 5 pages.

"Metallic Outlet Boxes," UL 514A, Underwriters Laboratories, Inc., Feb. 16, 2004 (Title Page Reprinted Aug. 10, 2007), 106 pages.

"Outlet Boxes for Use in Fire Rated Assemblies," https://www.ul.com/wp-content/uploads/2014/04/Ul_outletboxes.pdf, 2011, 2 pages.

2006 International Building Code, Section 712 Penetrations, 2006, 4 pages.

BXUV.GuideInfo, Fire Resistance Ratings—ANSI/UL 263, UL Online Certifications Directory, last updated Nov. 3, 2016, 27 pages.

Canadian Office Action dated Aug. 11, 2017 from Canadian Application No. 2,941,051, 4 pages.

Canadian Office Action dated Dec. 6, 2016 from Canadian Application No. 2,879,629, 3 pages.

Canadian Office Action dated Feb. 1, 2016 from Canadian Application No. 2,879,486, 5 pages.

Canadian Office Action dated Jun. 12, 2017 from Canadian Application No. 2,927,601, 4 pages.

Canadian Office Action dated Mar. 9, 2017 from Canadian Application No. 2,931,588, 5 pages.

CEYY.GuideInfo, Outlet Boxes and Fittings Certified for Fire Resistance, UL Online Certifications Directory, last updated May 16, 2013, 2 pages.

(56) References Cited

OTHER PUBLICATIONS

DMF, Inc., "dmfLIGHTING: LED Recessed Downlighting," DRD2 Product Brochure, Oct. 23, 2014, 49 pages.
DMF, Inc., "dmfLIGHTING: LED Recessed Downlighting," Product Catalog, Aug. 2012, 68 pages.
Final Office Action dated Apr. 27, 2016 from U.S. Appl. No. 14/184,601, 19 pages.
Final Office Action dated Jun. 23, 2016 from U.S. Appl. No. 13/484,901, 18 pages.
Non-Final Office Action dated Apr. 30, 2010 from U.S. Appl. No. 12/173,232, 13 pages.
Non-Final Office Action dated Mar. 15, 2010 from U.S. Appl. No. 12/100,148, 8 pages.
Non-Final Office Action dated Sep. 5, 2014 from U.S. Appl. No. 13/791,087, 8 pages.
Notice of Allowance dated Aug. 23, 2017 from Canadian Application No. 2,879,629, 1 page.
Notice of Allowance dated Jan. 16, 2015 from U.S. Appl. No. 29/467,026, 9 pages.
Notice of Allowance dated Jan. 30, 2015 from U.S. Appl. No. 13/791,087, 9 pages.
Notice of Allowance dated Oct. 21, 2016 from U.S. Appl. No. 13/484,901, 7 pages.
Notice of Allowance dated Mar. 26, 2018 for U.S. Appl. No. 14/184,601, 10 pages.
Non-Final Office Action dated Apr. 12, 2018 for U.S. Appl. No. 29/638,259, 5 pages.
Acrich COB Zhaga Module, Product Description, Seoul Semiconductor, Nov. 2016, 39 pages.
<https://www.zhagastandard.org/books/book18/>, Mar. 2017, 5 pages.
Non-Final Office Action dated May 16, 2018 from U.S. Appl. No. 15/132,875, 18 pages.
Notice of Allowance dated May 10, 2018 from U.S. Appl. No. 14/726,064, 7 pages.

* cited by examiner

ADJUSTABLE COMPACT RECESSED LIGHTING ASSEMBLY WITH HANGAR BARS

FIELD

An embodiment of the invention relates to recessed lighting systems that include a unified light source module and driver, coupled to a set of hangar bars.

BACKGROUND

Recessed lighting systems are typically installed or mounted into an opening in a ceiling or a wall. Modern recessed lighting systems generally consist of a trim, a light source module, a driver circuit, a "can" or housing, a junction box, and a set of hangar bars. The driver is insulated from other portions and components of the recessed lighting system, including the light source module, through the use of insulation provided by the junction box while the light source module is housed in the can. The driver is electrically coupled to the light source module through the use of wires or other conduits so that the driver can power the light source module to emit light.

The junction box, the can, and other components of the recessed lighting system are attached to the hangar bars such that the hangar bars may support the components of the recessed lighting system in a wall or ceiling of a structure. For example the junction box may be attached to the hangar bars through the use of screws and bolts, which anchor the junction box and driver. In contrast, the combined can and light source module, which is electrically connected to the junction box and driver, is moveable.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one.

DETAILED DESCRIPTION

Several embodiments are described with reference to the appended drawings are now explained. While numerous details are set forth, it is understood that some embodiments of the invention may be practiced without these details. In other instances, well-known circuits, structures, and techniques have not been shown in detail so as not to obscure the understanding of this description.

Figure 1:
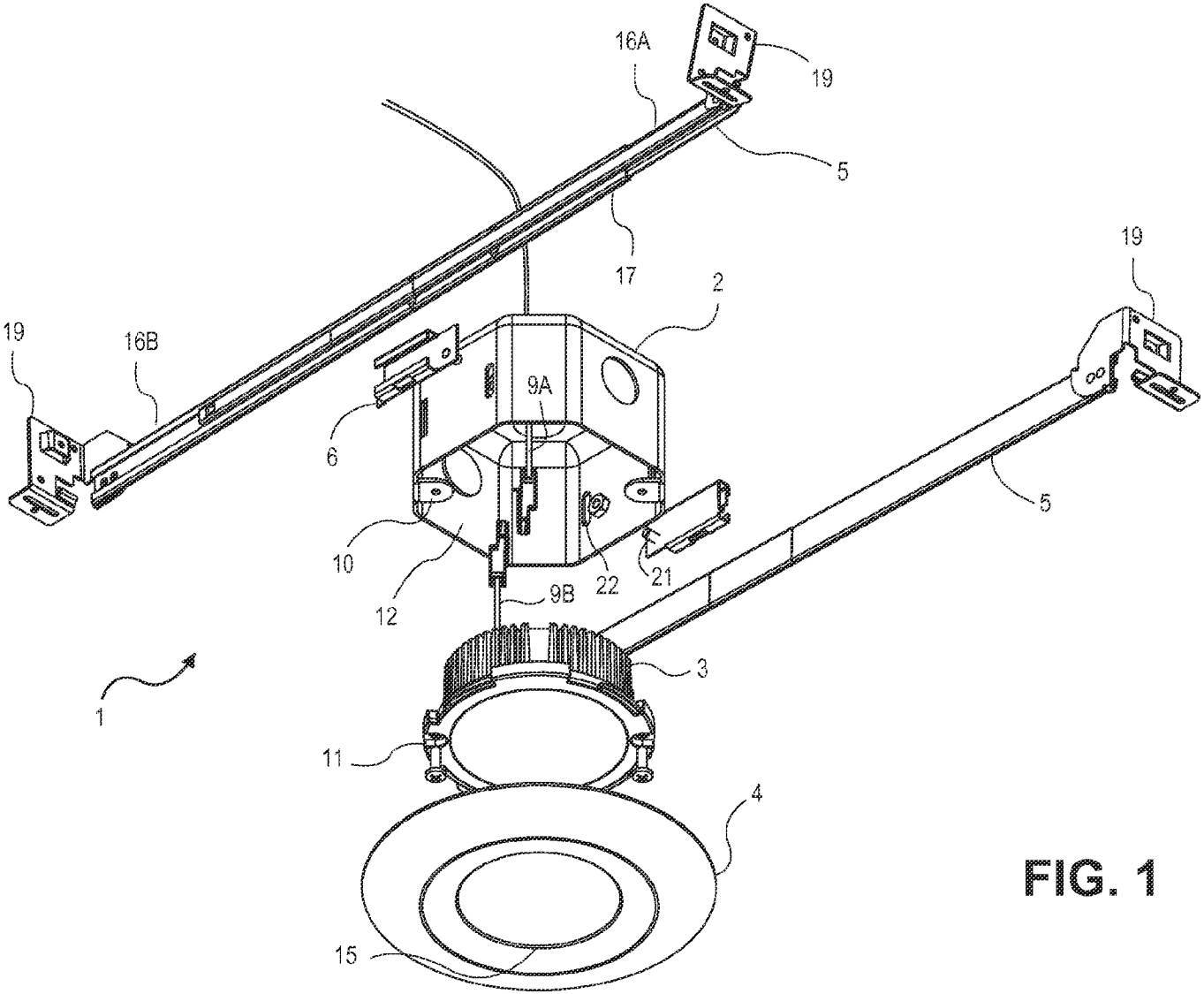
FIG. 1 shows an exploded view of a recessed lighting system according to one embodiment.
Figure 2:
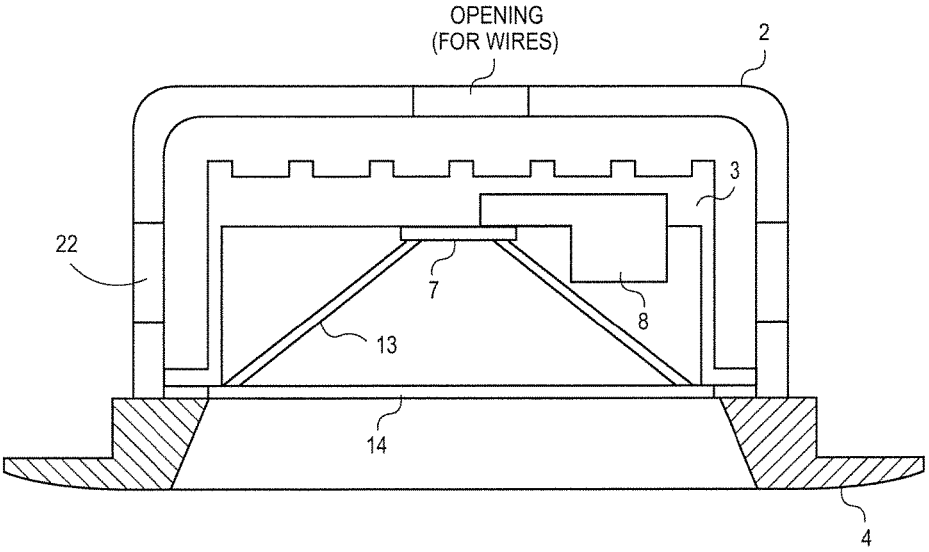
FIG. 2 shows a side view of a combined junction box, light source module, driver, unified casting, and trim of the recessed lighting system according to one embodiment.

FIG. 1 shows an exploded view of a recessed lighting system 1. The recessed lighting system 1 may include a junction box 2, a unified casting 3, a trim 4, a set of hangar bars 5, and a set of hangar holders 6. In some embodiments, the unified casting 3 may include a light source module 7 and a driver 8 in a single compact unit as shown in FIG. 2. As will be described in further detail below, the recessed lighting system 1 provides a more compact and cost effective design that allows the unified casting 3 to be moved and adjusted while complying with various building and safety codes/regulations. Each of the elements of the recessed lighting system 1 will be explained by way of example below.

The junction box 2 is a structure that separates the inner components of the recessed lighting system 1, including electrical wires/cables, from the items inside a ceiling or crawl space (e.g., insulation) in which the junction box 2 has been installed. In one embodiment, the junction box 2 may be a single or double gang box with a fire rating of up to two hours as described in the National Electrical Code (NEC) and by the Underwriters Laboratories (UL). The junction box 2 may receive electrical wires 9A from an electrical system (e.g., 120 VAC or 277 VAC) within a building or structure in which the recessed lighting system 1 is installed. The electrical wires 9A from the structure may be connected to corresponding wires 9B of the unified casting 3, as will be described in greater detail below.

In one embodiment, the junction box 2 may include one or more tabs 10 for coupling the junction box 2 to the casting 3. The tabs 10 may be any device/component for receiving corresponding elements 11 of the casting 3 to firmly hold the weight of the unified casting 3, including the light source module 7 and the driver 8 which may be contained in the casting 3. The trim 4 may also be attached to the junction box 2 to hide at least the periphery of the junction box from view. As shown in FIG. 1, the tabs 10 include holes for receiving screws or bolts; however, in other embodiments the tabs 10 may facilitate a twist-and-lock friction connection with corresponding elements 11 of the casting 3 and without the use of separate tools or other devices. In still other embodiments, friction or tension clips 24 may be utilized to retain the casting 3 inside the junction box 2.

Figure 3:
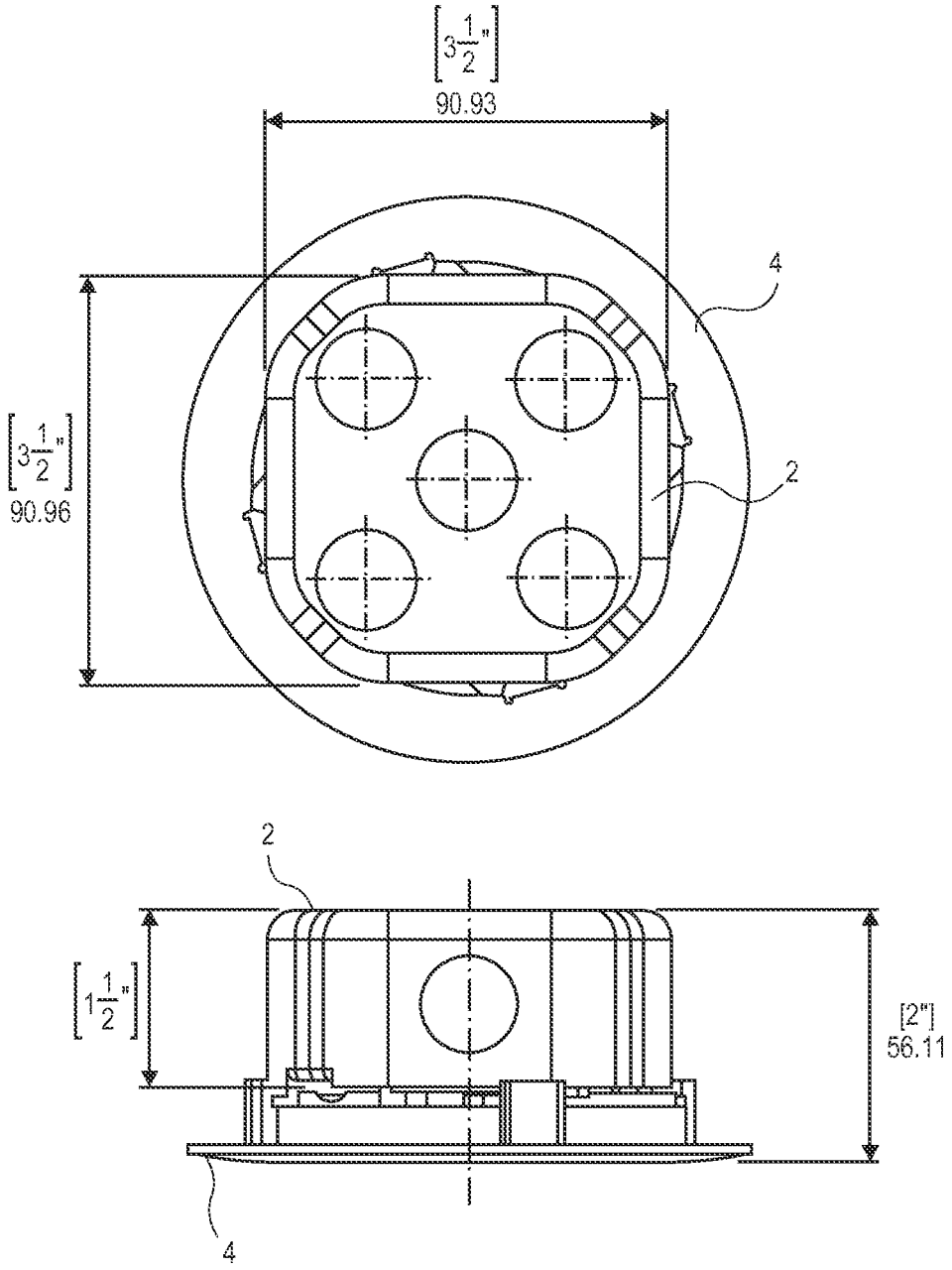
FIG. 3 shows top and side views of a junction box according to one embodiment.

In one embodiment, the junction box 2 acts as a heat barrier to block heat emitted by the light source module 7 and the driver 8 (See FIG. 2) from reaching possibly flammable items inside a ceiling or crawl space. Accordingly, the compact design may provide fire rating up to two hours. In these embodiments, the junction box 2 may be formed of metals, polymers, metal alloys, and/or other heat insulating materials. As shown in FIG. 1, the junction box 2 may be a polyhedron that defines a cavity 12 therein. However, in other embodiments, the side wall of the junction box 2 may be curved and have any suitable shape, including an ellipsoid, cone, or cylinder, so that the box is still capable of receiving therein the casting 3. The cavity 12 that is formed in the junction box 2 is larger than the casting 3 such that the casting 3 easily fits into the cavity 12, preferably without coming into direct contact with the side walls of the junction box 2. However, in other embodiments, the casting 3 may be sized to come into direct contact with the side walls of the junction box 2. The size of the cavity 12 may be pursuant to popular industry specifications for junction boxes and in compliance with any applicable building and safety codes/regulations. For example, as shown in the top and side views of FIG. 3, the junction box 2 may have a length of 3½ inches, a width of 3½ inches and a depth of 1½ inches. When coupled together, the combined junction box 2, casting 3, and trim 4 may have a height/depth of about 2 inches, e.g., no more than 3 inches. In one embodiment, the combined junction box 2, casting 3, and trim 4 may have a height/depth between 2-3 inches.

As shown in FIG. 1, the casting 3 may be a cylindrical structure; however, in other embodiments, the casting 3 may be any suitable shape, including an ellipsoid, cone, or polyhedron that is capable of housing the light source module 7 and the driver 8.

In one embodiment, the electrical wires 9A received by the junction box 2 from the electrical system of a building or structure may be coupled to the electrical wires 9B of the casting 3. As shown, the electrical wires 9A and 9B are connected together through the use of interlocking connectors that may be contained within the box 2 (together with the casting 3). However, in other embodiments, the electrical wires 9A may be coupled to the electrical wires 9B through the use of electrical caps or other devices, and that may be kept outside the box 2 (while the casting 3 is retained inside). The electrical wires 9B of the casting 3 may terminate in a connection with the driver 8 installed within the casting 3. When the wires 9A and 9B are connected, electricity may pass from the electrical system of the building or structure to the driver 8 to enable the driver 8 to power the light source module 7.

In one embodiment, the casting 3 includes one or more heat sinks to dissipate heat generated by the light source module 7 and/or the driver 8. Although the heat sinks are shown as passive components that cool the combined casting 3, light source module 7, and driver 8 by dissipating heat into the surrounding air, active heat sinks (e.g., fans) may also be used. In one embodiment, the heat sinks are defined by a set of fins surrounding the casting 3. The heat sinks may be composed of any thermally conductive material. For example, the heat sinks may be made of aluminium alloys, copper, copper-tungsten pseudoalloy, AlSiC (silicon carbide in aluminium matrix), Dymalloy (diamond in copper-silver alloy matrix), E-Material (beryllium oxide in beryllium matrix), and/or thermally conductive plastics or ceramics.

As described above, the recessed lighting system 1 may include the driver 8. The driver 8 is an electronic circuit or device that supplies and/or regulates electrical energy to the light source module 7 and thus powers the light source module 7 to emit light. The driver 8 may be any type of power supply, including power supplies that deliver an alternating current (AC) or a direct current (DC) voltage to the light source module 7. Upon receiving electricity, the driver 8 may regulate current or voltage to supply a stable voltage or current within the operating parameters of the light source module 7. The driver 8 receives an input current from the electrical system of the building or structure in which the recessed lighting system 1 is installed and may drop the voltage of the input current to an acceptable level for the light source module 3 (e.g., from 120V-240V to 36V-48V). The driver 8 may transfer electricity to the light source module 7 through an electrical connector. For example, the driver 8 may deliver electricity to the light source module 7 through an electrical cable coupled between the light source module 7 and the driver 8 through removable or permanent connectors or soldered leads originating from the driver 8. Although shown with magnetic transformer 18, the driver 8 may include additional or alternative circuitry for voltage conversion and for regulating the input current or voltage to the light source module 7.

The light source module 7 may be any electro-optical device or combination of devices for emitting light. For example, the light source module 7 may have as a single light source a light emitting diode (LED), organic light-emitting diode (OLED), or polymer light-emitting diode (PLED). In some embodiments, the light source module 7 may have multiple light sources (e.g., LEDs, OLEDs, and/or PLEDs). The light source module 7 receives electricity from the driver 8, as described above, such that the light source module 7 may emit a controlled beam of light into a room or surrounding area. The driver 8 is designed to ensure that the appropriate voltage and current are fed to the light source module 7 to enable the emission of light by the one or more light sources within the light source module 7.

The light source module 7 and the driver 8 may be coupled to the casting 3 using any connecting mechanism, including screws, resins, clips, or clamps. For example, in one embodiment, the light source module 7 and the driver 8 may be coupled to the casting 3 using friction or tension clips.

In some embodiments, the recessed lighting system 1 may include a reflector 13 (See FIG. 2). The reflector 13 may surround the light source module 7, or just a light source of the light source module 7, to adjust the way light emitted by the light source module 7 is focused inside a room or surrounding area. In one embodiment, the reflector 13 surrounds the light source module 7 and also separates the light source module 7 from the driver 8. This separation allows light from the light source module 7 to be emitted into a room or surrounding area, while shielding the driver 8 from being exposed to the room or surrounding area. For example, in one embodiment, the reflector 13 and the casting 3 may together create a sealed structure to shield the driver 8 from the outside environment and the light source module 7. By shielding the driver 8 from the outside environment, the reflector 13 might reduce the risk of fire or other dangers and ensures the recessed lighting system 1 complies with building and safety codes/regulations. The reflector 13 may be formed of any fire retardant material, including steel, aluminum, metal alloys, calcium silicate, and other similar materials.

Although shown as frusto conical, the reflector 13 may be formed in any shape that may direct and/or focus light. For example, the reflector 13 may be parabolic or spherical. In one embodiment, the front surface of the reflector 13 may be coated with a reflecting material or include one or more reflecting elements that assists in the adjustment of light emitted by the light source module 7. For example, the reflector 13 may be coated with a shiny enamel or include one or more mirrors or retroreflectors or a microcellular polyethylene terephthalate (MCPET) material to adjust the focus of light emitted by the light module 7. In other embodiments, the reflector 13 may include various other optic elements to assist in the focusing of light emitted by the light source module 7.

In one embodiment, the recessed lighting system 1 may include a lens 14 (See FIG. 2). The lens 14 may be formed to converge or diverge light emitted by the light source module 7. The lens 14 may be a simple lens comprised of a single optical element or a compound lens comprised of an array of simple lenses (elements) with a common axis. In one embodiment, the lens 14 also provides a protective barrier for the light source module 7 and shields the light source module 7 from moisture or inclement weather. The lens 14 may also assist in the diffusion of light and increase the uniformity of light over the surface of the recessed lighting system 1. The lens 14 may be made of any at least partially transparent material, including glass and hard plastics. In one embodiment, the lens 14 and the reflector 13 are contained in a single indivisible unit to work in conjunction to focus and adjust light emitted by the light source module 7. In other embodiments, the lens 14 and the reflector 13 may be separate, divisible elements.

In one embodiment, the recessed lighting system 1 may include a trim 4. The trim 4 serves the primary purpose of covering the exposed edge of the ceiling or wall where a hole is formed in which the recessed lighting system 1 resides while still allowing light from the light source module 3 to be emitted into a room through an aperture 15. In doing so, the trim 4 helps the recessed lighting system 1 appear seamlessly integrated into the ceiling or wall. In one embodiment, the trim 4 is to be attached to the casting 3 while in other embodiments the trim 4 is to be attached to the junction box 2. The trim 4 may couple to the casting 3 and/or the junction box 2 using any connecting mechanism, including resins, clips, screws, bolts, or clamps. In one embodiment, the trim 4 may include grooves and/or slots to couple to corresponding grooves and/or slots of the casting 3 and/or the junction box 2 using a twist-and-lock friction connection and without the use of separate tools or other devices.

In one embodiment, different diameter trims 4 may be capable of being coupled to the casting 3 and/or the junction box 2. The size and design of the trims 4 may depend on the size of the hole in which the recessed lighting system 1 has been fitted to conceal the exposed wall or ceiling edge that defines the hole. As well, the trim 4 may need to meet the aesthetic demands of the consumer. The trim 4 may be made of aluminum plastic polymers, alloys, copper, copper-tungsten pseudoalloy, AlSiC (silicon carbide in aluminum matrix), Dymalloy (diamond in copper-silver alloy matrix), and E-Material (beryllium oxide in beryllium matrix).

In one embodiment, the recessed lighting system 1 may include a set of hangar bars 5 as shown in FIG. 1. The hangar bars 5 may be rigid, elongated members that are connected between adjacent joists and/or beams in the walls or ceilings of a structure (See FIG. 5). In one embodiment, each of the hangar bars 5 may be telescoping such that each hangar bar 5 may be extended or retracted to meet the gap between the joists and/or beams. In this embodiment, each hangar bar 5 may include an inner bar element 16A and an outer bar element 16B. The inner bar element 16A may be inserted and then held inside a railing structure 17 formed on the outer bar element 16B. In this configuration, the inner bar element 16A may slide in relation to the outer bar element 16B to vary the total length of each hangar bar 5. In one embodiment, the railing structure 17 within the outer bar element 16B may be formed by a set of guides. The guides may be bent pieces of the outer bar element 16B or tabs that are coupled to the outer bar element 16B. In this fashion, the railing structure 17 forms a channel for the inner bar element 16A.

In one embodiment, each of the hangar bars 5 may include a set of mounting blocks 19. The mounting blocks 19 may be used to couple the hangar bars 5 to the joists and/or beams in the walls or ceilings of a structure. For example, as shown in FIG. 1, the mounting blocks 19 may include holes for receiving screws and/or nails or other fasteners that enable the hangar bars 5 to be securely attached to a building structure. Although shown in FIG. 1 and described above in relation to holes and screws, in other embodiments, other mechanisms of attachment may be used in conjunction with the mounting blocks 19, including resins, clips, or clamps to attached the bars 5 to the building structure. In one embodiment, the mounting blocks 19 may be integrated in one indivisible structure along with the inner bar element 16A and the outer bar element 16B, while in other embodiments, as shown in FIG. 1, the mounting blocks 19 may be coupled to the inner bar element 16A and the outer bar element 16B through the use of one or more attachment mechanisms (e.g., screws, bolts, resins, clips, or clamps). Using the above telescoping and mounting features, the recessed lighting system 1 may be installed in almost all the 2"×2" through 2"×16" wood joist constructions, metal stud constructions, and t-bar ceiling constructions.

Figure 4:
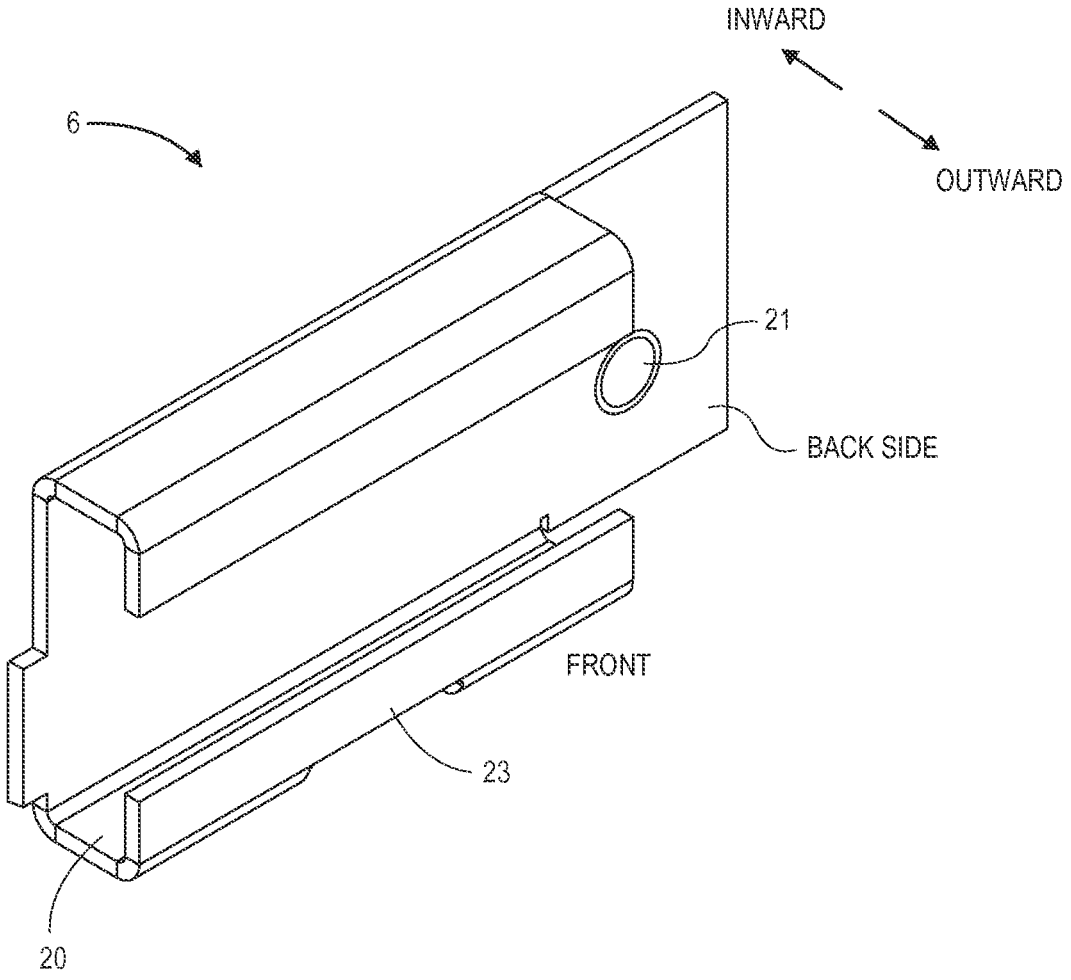
FIG. 4 shows a perspective view of a hangar holder according to one embodiment.

In one embodiment, the recessed lighting system 1 may include a set of hangar holders 6. The hangar holders 6 may be configured to slide or otherwise move along corresponding hangar bars 5. For example, FIG. 4 shows a perspective view of a hangar holder 6 according to one embodiment. As shown in FIG. 4, the hangar holder 6 may form a railing structure 20 to meet the dimensions of the hangar bars 5. Similar to the railing structure 17 of the outer arm elements 16B, the railing structure 20 of the hangar holders 6 may be formed by a set of guides. The guides may be bent pieces of the hangar holders 6 or tabs that are coupled to the hangar holders 6. As described above, the railing structure 20 of the hangar holder 6 allows the hangar holders 6 to slide along the hangar bars 5.

Figure 5:
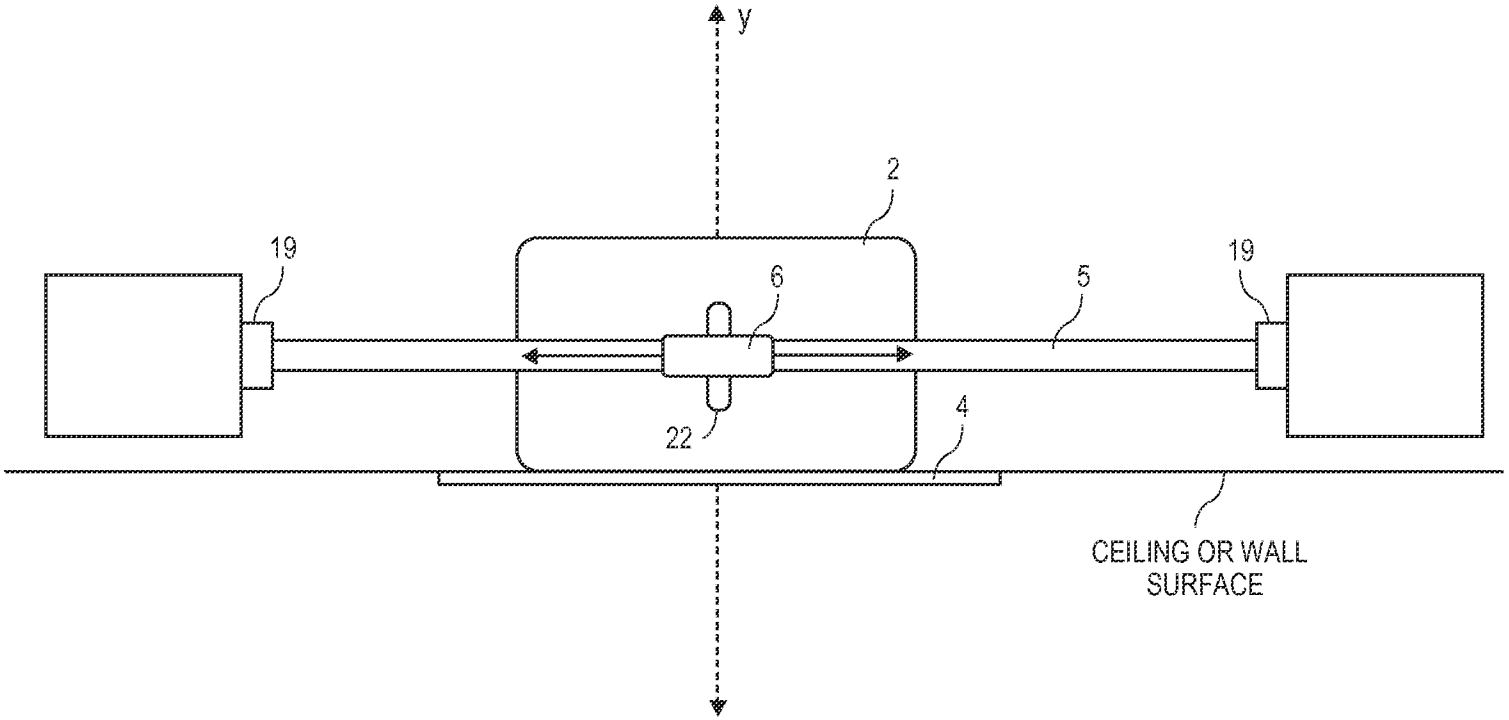
FIG. 5 shows how the junction box and hangar holders can be moved and positioned horizontally along hangar bars and vertically along the axis Y according to one embodiment.

In one embodiment, the hangar holders 6 may include an attachment mechanism 21 for coupling with the junction box 2. The attachment mechanism 21 may be any mechanism that allows the junction box 2 to be removably connected to the hangar bars 5. For example, as shown FIG. 1 and FIG. 4, the attachment mechanism 21 may be a hole that is to receive a screw 25 or bolt therein. However, in other embodiments, the attachment mechanism 21 may include resins, clips, and/or clamps that allow the hangar holders 6 to be coupled to the junction box 2. By being coupled to the hangar holders 6, the junction box 2, along with the light source module 7 and the driver 8 therein, may be moved across the hangar bars 5 to a desired location as shown in FIG. 5. Accordingly, during installation of the recessed lighting system 1, the hangar bars 5 may be installed inside a gap between beams within a structure by affixing the mounting blocks 19 to the beams, and then the junction box 2, along with the light source module 7 and the driver 8 therein, may be moved by the installer to a desired location along the hangar bars 5 and within the gap.

Figure 6:
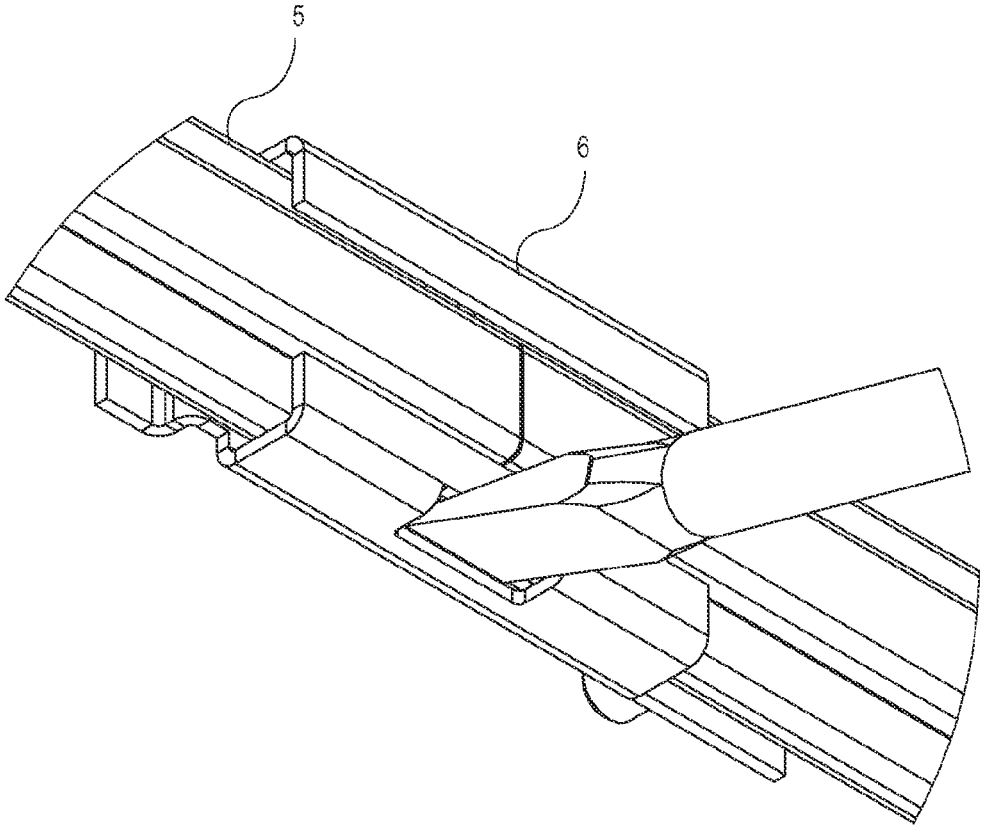
FIG. 6 shows a perspective view of a screwdriver bending a tab of a hangar holder to lock the hangar holder in a position along the hangar bars according to one embodiment.

In one embodiment, the recessed lighting system 1 may include a hangar holder lock 23, which locks the hangar holder 6 at a certain position along the hangar bar 5. The hangar holder lock 23 may be any device or mechanism that locks or secures the hangar holder 6 at a certain position along the hangar bar 5. For example, in one embodiment, one or both of the hangar holder 6 may include a tab, which acts as the hangar holder lock 23. The tab may be bent (e.g., using a screwdriver as shown in FIG. 6) through an opening such that the tab is forced against its corresponding hangar bar 5, or alternatively a portion of the bar 5 is bent and forced against the holder 6, like a pinching action. This friction/tension caused by bending the tab or by bending the bar 5 locks or secures the hangar holder 6 in a desired position along the hangar bar 6.

Referring back to FIG. 1, in one embodiment, the junction box 2 may include a complimentary slot 22 to engage with the attachment mechanism 21 of the hangar holder 6 (FIG. 4). The slot 22 allows the junction box 2 to be coupled to the hangar holder 6 in one of a number of positions along the bar 5. In this case, the slot 22 is oriented parallel to an axis that is perpendicular to the hangar bars 5 (e.g., a Y-axis). For example, the junction box 2 may be moved along the axis Y as shown in FIG. 5 before being locked in a particular position. In this embodiment, the axis Y may be perpendicular as shown in FIG. 5 but more generally it may be not parallel to the longitudinal axis of the hangar bar 5. Accordingly, the junction box 2, along with the light source module 7 and the driver 8, may be moved and/or adjusted in another direction. This adjustment may assist in ensuring that the frontmost surface of the unified casting 3 that is attached inside the junction box 2 is flush or sufficiently close to the ceiling or wall during installation. In one embodiment, as shown in FIG. 1, the attachment mechanism 21 may form a pin for insertion into the slot 22. In this embodiment, the pin may be sized to slide along the length of the slot 22 and the pin may include a hole for receiving a screw or bolt such that the hangar holder 6 may be securely coupled to the junction box 2.

Figure 7:
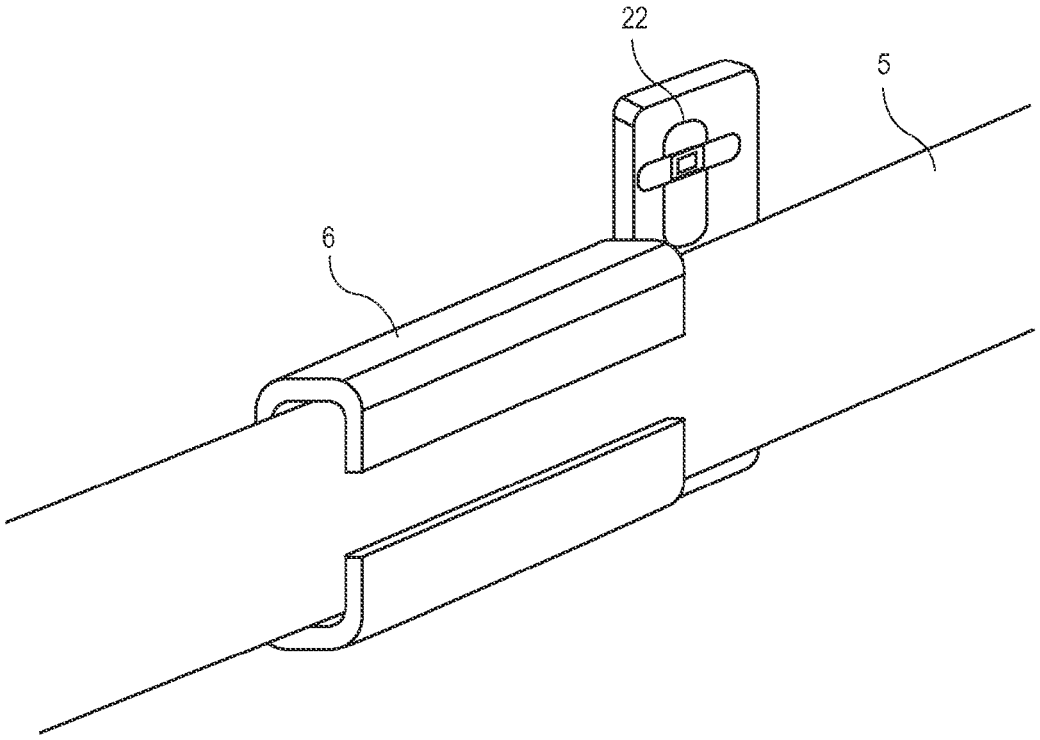
FIG. 7 shows a perspective view of a hangar holder according to another embodiment.

Although described as being part of the junction box 2, in some embodiments the slot 22 may be part of the hangar holder 6. For example, as shown in FIG. 7, the slot 22 is formed on the back side of the hangar holder 6 rather than in the sidewall of the junction box 2. In this embodiment, the attachment mechanism 21 may be moved to the junction box 2.

The locking of the junction box 2 in a position along the movement axis may be performed using any locking mechanism. In one embodiment, as seen in FIG. 1, the junction box 2 may be locked into a position along the axis Y by tightening a nut on a respective screw or bolt that links the attachment mechanism 21 and the slot 22. The nut may be accessible through the cavity 12 of the junction box 2, such that the junction box 2 may be easily locked at a particular position along the axis Y during installation of the recessed lighting system 1 inside a ceiling or wall of a structure.

As described above, traditional recessed lighting systems provide a separation between a driver and a light source module. This separation adds to the combined size of the recessed lighting system. In particular, a junction box and a can, which respectively house the driver and light source module in these traditional recessed lighting systems must be separately mounted on the hangar bars. This separate mounting requires additional hardware and bulk. Further, movement and/or adjustment of the light source module may be difficult in these recessed lighting systems as the combined junction box and driver are static As described above, the hangar holders 6 described herein allow the junction box 2 to be moved in a direction parallel to a longitudinal axis of the hangar bars 5 and in a direction not parallel (e.g., perpendicular) to the hangar bars 5 (e.g., the axis Y). Accordingly, the junction box 2 may be moved to a preferred location between a set of joists or beams in a structure and at a desired height before the being locked into position using the mechanisms 21 and 22. The casting 3 is then positioned inside the box 2 as shown. By being configured such that the junction box 2, along with the light source module 7 and the driver 8 therein, is coupled to a unified set of moveable elements that assist in positioning the combined structure, the recessed lighting system 1 eliminates the added bulk and size of traditional recessed lighting systems. In particular, the recessed lighting system 1 allows adjustment of the position of the light source module 7 between joists or beams without the need for a compartment or can dedicated to housing the light source module 7 and a separate compartment dedicated to housing the driver 8. Instead, the light source module 7 may be housed along with the driver 8 in a shared junction box 2 that jointly moves these elements to a desired position. This compact design provides an affordable design by cutting the cost of raw materials and other components and reduces shipping costs by reducing bulk. Also, by having the driver 8 and the light source module 7 placed in the junction box 2, serviceability and replacement of the driver 8 will be easier to perform and more convenient. In contrast, traditional housings have the driver 8 mounted on the junction box 2 and contractors are forced to spend a significant amount of time removing parts to gain access to the junction box 2 and the driver 8.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. The description is thus to be regarded as illustrative instead of limiting.

What is claimed is:

1. A compact recessed lighting system, comprising:

a junction box having a sidewall that joins a top, defines an open bottom, and surrounds a cavity, wherein the junction box is fire-resistant and complies with an Underwriters Laboratories (UL) fire rating of up to two hours;

a unified casting having contained therein a light source module for emitting light and that is attached to a top inside surface of the unified casting, wherein the unified casting is at least partially positioned inside the cavity of the junction box such that the light source module is contained within the cavity of the junction box;

a driver for powering the light source module and that is positioned inside the cavity of the junction box;

a plurality of hangar bars for holding the junction box in a gap between beams in a structure, each one of the plurality of hangar bars being attached to one of a plurality of single piece hangar bar holders;

wherein each of the plurality of single piece hangar bar holders is moveably coupled to the junction box through an attachment mechanism formed on each of the plurality of single piece hangar bar holders, wherein each attachment mechanism is received in a corresponding one of a plurality of holes formed in the sidewall of the junction box, wherein each single piece hangar bar holder has a front side facing inward towards the sidewall of the junction box, a back side facing outward, and a hangar bar holder railing structure extending outward that is to slide along a corresponding one of the hangar bars.

2. The compact recessed lighting system of claim 1, wherein the junction box is movable along an axis perpendicular to the hangar bars.

3. The compact recessed lighting system of claim 1, wherein each of the hangar bar holders includes a hangar bar holder lock to secure the hangar bar holders at a position along the hangar bars.

4. The compact recessed lighting system of claim 1, wherein each hangar bar in the plurality of hangar bars, comprises:

an inner bar element; and an outer bar element that includes an outer bar railing structure for receiving the inner bar element, wherein the inner bar element slides along the outer bar railing structure to retract within the outer bar element or telescope from the outer bar element.

5. The compact recessed lighting system of claim 1, wherein each hangar bar in the plurality of hangar bars, comprises:

a pair of mounting blocks, wherein each of the mounting blocks includes attachment mechanisms for coupling to a structure.

6. The compact recessed lighting system of claim 1, wherein the junction box has a depth between 2 inches and 3 inches.

7. The compact recessed lighting system of claim 1, further comprising:

a trim coupled to the unified casting for covering a hole in a wall or ceiling in which the compact recessed lighting system is placed.

8. The compact recessed lighting system of claim 1, wherein the light source module is a light emitting diode (LED) module.

9. The compact recessed lighting system of claim 1, wherein at least one of the single piece hangar bar holders comprises a hangar bar holder lock for securing one of the plurality of single piece hangar bar holders in place along one of the hangar bars.

10. The compact recessed lighting system of claim 9, wherein the hangar bar holder lock comprises a bendable tab.

11. A compact recessed lighting system, comprising:

a fire-resistant junction box having (i) a unified casting in which a light source module for emitting light is attached to a top inside surface of the unified casting and a driver circuit for powering the light source module is coupled to the unified casting, wherein the unified casting is at least partially positioned inside the fire-resistant junction box; and (ii) a first plurality of electrical wires coupled to the driver circuit and inside the fire-resistant junction box together with the unified casting, the first plurality of electrical wires to be connected inside the junction box to a second plurality of electrical wires from an electrical system of a building to deliver AC power to the driver circuit;

a plurality of hangar bars for holding the junction box, along with the light source module and driver circuit housed therein, in a gap between beams in a structure, wherein the junction box is moveably coupled to the hangar bars such that the junction box is configured to slide along the hangar bars and move along an axis perpendicular to the hangar bars; and a plurality of hangar bar holders for coupling the junction box, along with the light source module and driver circuit housed therein, to the hangar bars, wherein each of the hangar bar holders includes a hangar bar holder railing structure that is configured to slide along a corresponding hangar bar;

wherein the junction box has a sidewall and a top end that surrounds a cavity, wherein the sidewall defines a bottom opening of the junction box, wherein the junction box includes a plurality of holes each for receiving an attachment mechanism of a corresponding one of the plurality of hangar bar holders, wherein the attachment mechanism allows the junction box, along with the light source module and driver circuit, to move along the axis perpendicular to the hangar bars to ensure that a frontmost surface of the unified casting is flush or sufficiently close to a ceiling or wall through which the compact recessed lighting system is installed.

12. The system of claim 11, wherein each of the plurality of hangar bar holders is a separate piece than the junction box and has the corresponding attachment mechanism, which comprises a pin that extends through a corresponding hole in the plurality of holes formed in a sidewall of the junction box, wherein a length of the hole of the junction box substantially defines the range of positioning of the junction box along the perpendicular axis.

13. The system of claim 12, wherein each of the plurality of hangar bar holders has a tab that is to be bent inward to pinch the hangar bar between the tab and a wall of each of the plurality of hangar holders and thereby lock each of the plurality of hangar holders in a desired position along the hangar bar.

14. The system of claim 13, wherein each of the plurality of hangar bars comprises a slide rail whose length is adjustable.

15. The system of claim 14, wherein each of the plurality of hangar bar holders has a substantially C-shaped cross-section into which the slide rail of the hangar bar is fitted to slide in, and wherein the pin extends inward from a back side of each of the plurality of the hangar bar holders and into the corresponding hole in the plurality of holes formed in the sidewall of the junction box.

16. The system of claim 11, wherein each of the plurality of the hangar bar holders comprises a hangar bar holder lock for securing the hangar bar holder in place along one of the plurality of hangar bars.

17. The system of claim 16, wherein the hangar bar holder lock comprises a bendable tab.

18. A recessed lighting system, comprising:

a single fire-resistant junction box to contain both a light source module and at least one electrical connection to couple the light source module to an electrical system of a building or structure in which the recessed lighting system is installed;

a unified casting disposed in the single fire-resistant junction box, the unified casting containing at least the light source module;

a driver disposed in the single fire-resistant junction box and coupled to the light source module to provide power to the light source module;

a first plurality of wires coupled to the driver and disposed in the single fire-resistant junction box to electrically connect the driver to the electrical system of the building or structure in which the recessed lighting system is installed; and a plurality of hangar bars coupled to the single fire-resistant junction box to hold the single fire-resistant junction box in a gap between beams in the building or structure in which the recessed lighting system is installed, wherein the single fire-resistant junction box is moveably coupled to the plurality of hangar bars to adjust a position of the single fire-resistant junction box in a direction perpendicular to a ceiling or wall of the building or structure in which the recessed lighting system is installed.

19. The recessed lighting system of claim 18, wherein the single fire-resistant junction box complies with an Underwriters Laboratories (UL) fire rating of up to two hours.

20. The recessed lighting system of claim 18, wherein the single fire-resistant junction box is moveably coupled to the plurality of hangar bars to adjust the position of the single fire-resistant junction box to ensure that a frontmost surface of the unified casting is flush or sufficiently close to the ceiling or wall of the building or structure in which the recessed lighting system is installed.

21. The recessed lighting system of claim 18, wherein the unified casting contains the driver.

22. The recessed lighting system of claim 18, wherein the unified casting contains the driver.

* * * * *